US006542026B2

(12) United States Patent
Wu et al.

(10) Patent No.: US 6,542,026 B2
(45) Date of Patent: Apr. 1, 2003

(54) APPARATUS FOR ON-CHIP REFERENCE VOLTAGE GENERATOR FOR RECEIVERS IN HIGH SPEED SINGLE-ENDED DATA LINK

(75) Inventors: Chung-Hsiao R. Wu, Sunnyvale, CA (US); Jyh-Ming Jong, Saratoga, CA (US); Prabhansu Chakrabarti, Sunnyvale, CA (US); Leo Yuan, Los Altos, CA (US)

(73) Assignee: Sun Microsystems, Inc., Palo Alto, CA (US)

( * ) Notice: Subject to any disclaimer, the term of this patent is extended or adjusted under 35 U.S.C. 154(b) by 0 days.

(21) Appl. No.: 09/931,696

(22) Filed: Aug. 15, 2001

(65) Prior Publication Data

US 2003/0034829 A1 Feb. 20, 2003

(51) Int. Cl.[7] ..... G05F 1/10

(52) U.S. Cl. ..... 327/540

(58) Field of Search ..... 327/530, 534, 327/535, 537, 538, 540, 541, 543

(56) References Cited

U.S. PATENT DOCUMENTS 6,377,133 B1 * 4/2002 Ihmels et al. ..... 333/158
2001/0017567 A1 * 8/2001 Kawakubo ..... 327/540

* cited by examiner

*Primary Examiner*—Jeffrey Zweizig
(74) *Attorney, Agent, or Firm*—O'Melveny & Myers LLP

(57) ABSTRACT

An on-chip DC voltage generator providing a marginable reference voltage signal is described. The present invention is a CMOS-based integrated circuit that generates a marginable reference voltage level. The present invention provides a process insensitive reference voltage signal and may be configured so as to generate a ground-bounce-noise free signal.

20 Claims, 3 Drawing Sheets

FIG. 3
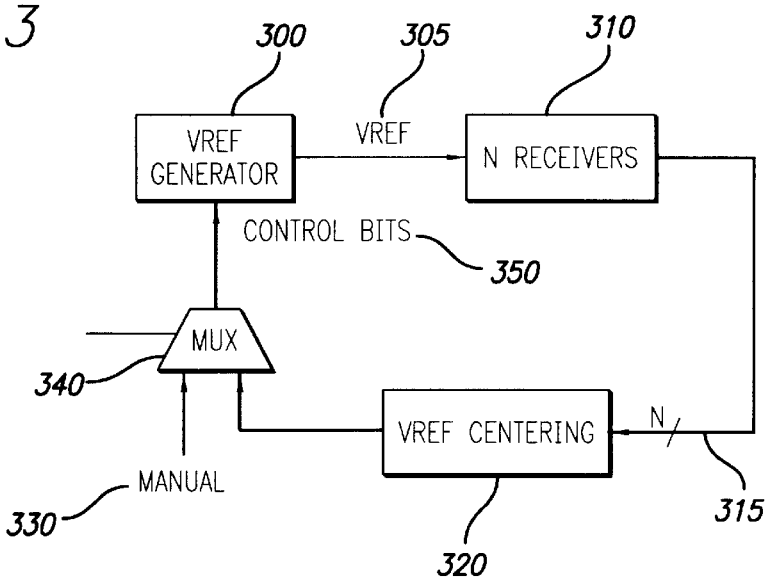
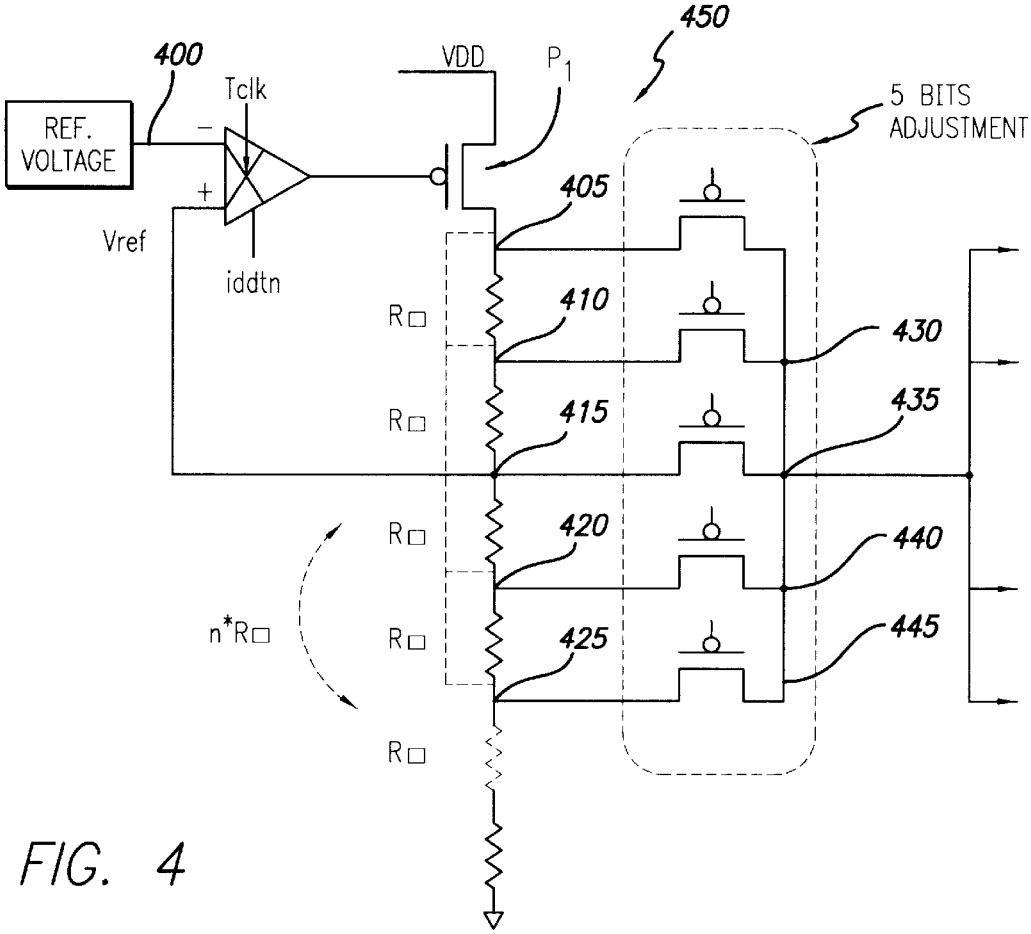
FIG. 4

APPARATUS FOR ON-CHIP REFERENCE VOLTAGE GENERATOR FOR RECEIVERS IN HIGH SPEED SINGLE-ENDED DATA LINK

BACKGROUND OF THE INVENTION

1. Field of the Invention

This invention relates to the field of DC voltage generators and in particular to an on-chip DC voltage generator.

2. Background Art

The operation of integrated circuits often requires that a signal be compared to a reference level such as a reference voltage. An external DC voltage generator is traditionally used to provide this reference signal. Using an external DC voltage generator, as will be further explained below, is disadvantageous in terms of the physical limitations of the IC and the complexity it adds to the system.

The generator is typically either a voltage divider or resistor network. Decoupling capacitors are often used to bypass the frequency-dependent noise and prevent the noise from injecting into the chip. This reference signal, Vref, is usually set at the center of the data eye pattern. A data eye pattern is the superposition of the ones and zeroes output from a high speed system or circuit. This pattern is obtained by sampling a long pseudo-random-bit-sequence output from the system under study. The horizontal width of the lines gives the jitter (phase noise) and the rise and fall times of the data pulses can be measured from the crossings of the sampled signals.

A prior art voltage generator configuration is illustrated in FIG. 1. FIG. 1 comprises a chip 100 connected to M external voltage generators 105. Each external voltage generator 105 is associated to a bank of N data lines 110 through N comparators 115. Each voltage generator 105 is connected to common ground 120. In operation each voltage generator 105 supplies a reference voltage to each comparator 115 in its associated bank. The reference voltages may differ as between each generator 105.

A comparator is an operational amplifier, or op-amp. A comparator comprises two input terminals, positive (+) and negative (−). The signal generated by a comparator indicates which of these two voltages is greater:

$$Vo=A(Vp-Vn)$$

where A is the open-loop voltage gain of the amplifier, Vp is the positive input voltage and Vn is the negative input voltage. Both Vp and Vn are node voltages with respect to ground.

There are numerous drawbacks inherent in the use of an external reference voltage source. In coupling the source to the chip, the leads necessarily occupy package pin counts and IO pads on the chip. This configuration generates noise coupling from the board, as well as noise generated by inductive Vref pins. The use of multiple components complicates board routing. Finally, external reference voltage generators require R/C components.

SUMMARY OF THE INVENTION

An on-chip DC voltage generator providing a marginable reference voltage signal is described herein. Embodiments of the present invention are Complementary Metal Oxide Semiconductor (CMOS)-based integrated circuits that generate marginable reference voltage level. One embodiment of the present invention generates a process insensitive reference voltage signal. A separate embodiment of the present invention generates a ground-bounce-noise free reference voltage signal. Another embodiment of the present invention implements a voltage margining scheme. A marginable DC voltage generator may produce several discrete Vref levels. This circuit is said to be marginable because the several voltage levels are available for use at any time.

BRIEF DESCRIPTION OF THE DRAWINGS

FIG. 3 is a block diagram illustrating the control methodology of the present invention.

FIG. 4 is a circuit diagram illustrating a process-independent embodiment of the present invention.

DETAILED DESCRIPTION OF THE INVENTION

An novel on-chip DC voltage generator providing a marginable reference voltage signal is described. In the following description, numerous specific details are set forth to provide a more thorough description of embodiments of the invention. It is apparent, however, to one skilled in the art, that the invention may be practiced without these specific details. In other instances, well known features have not been described in detail so as not to obscure the invention.

Figure 1:
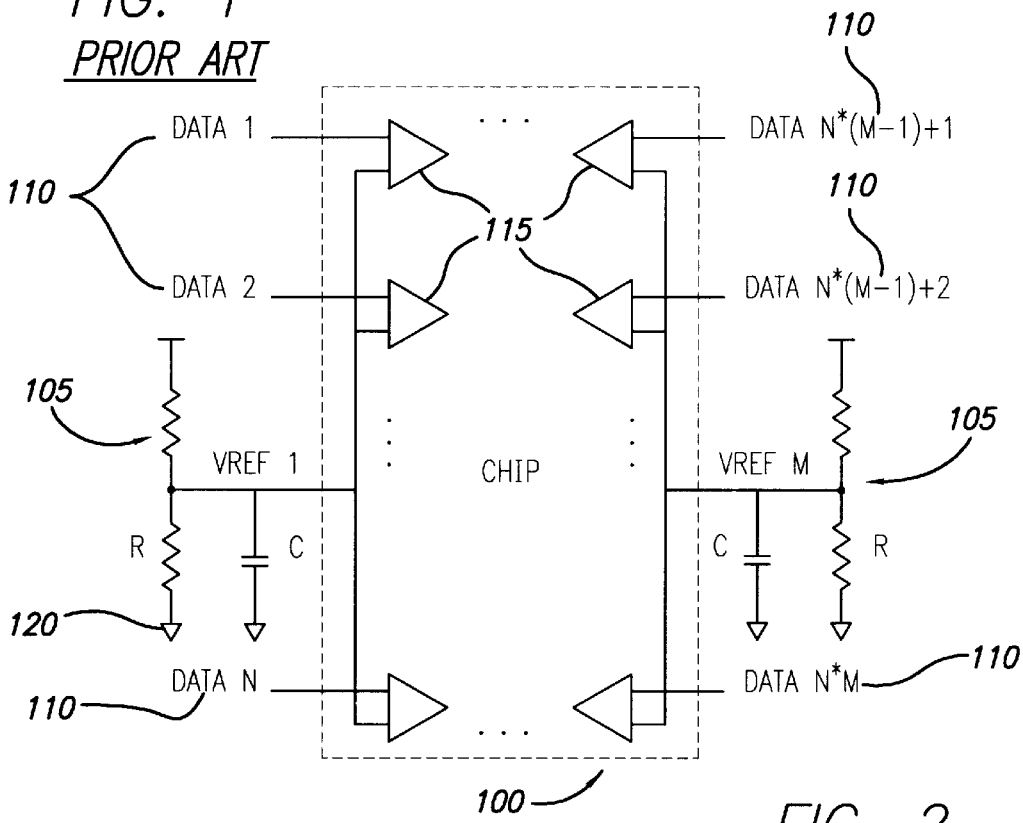
FIG. 1 PRIOR ART
FIG. 1 is a block diagram illustrating a prior art external DC reference voltage generator configuration.
Figure 2:
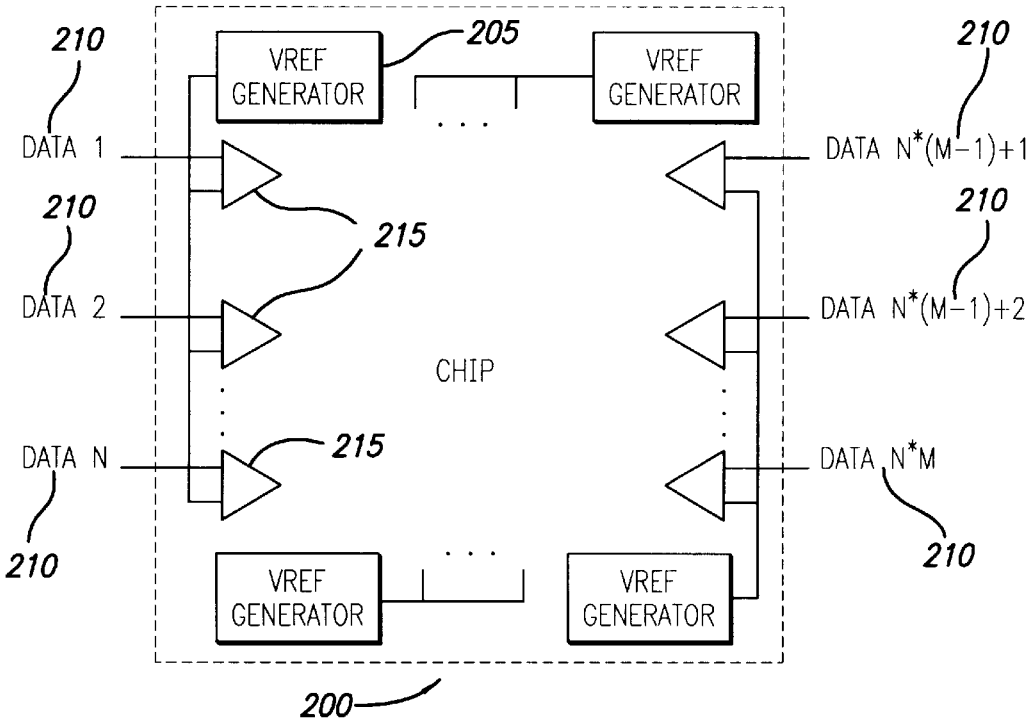
FIG. 2 is a block diagram illustrating the present invention.

FIG. 2 is a block diagram illustrating the present invention. Chip 200 is connected to M on-chip voltage generators 205. Each on-chip voltage generator 205 is associated to a bank of N data lines 210 through N comparators 215. In operation each voltage generator 205 supplies a reference voltage to each comparator 215 in its associated bank. The reference voltages may differ as between each generator 205.

An IC configuration in which the reference voltage generators are on-chip solves many disadvantages of an external voltage generator configuration. Manufacturing costs are lowered because package pin counts and Vref_IO pad counts are reduced. Board routing capacity is improved. Board discrete R and C component count is reduced. The path of external board noise impact to Vref is eliminated. Last, this configuration eliminates the Vref (Miller) transient current induced noise on inductive parasitic Vref package pins.

FIG. 3 is a block diagram illustrating the control methodology of the present invention. Vref generator block 300 produces a Vref signal 305. Vref 305 is received by N receivers, represented by block 310. Vref centering circuitry, represented by block 320, improves the noise margin by centering the Vref level in the received data eye pattern of the N system outputs 315. MUX 340 generates control bits 350 based on the signal generated by the Vref centering circuitry and either an automatic control or manual software control 330. Control bits 350 regulate the marginable Vref generator 300.

The feedback control system illustrated in FIG. 3 overcomes several disadvantages of external Vref generators. The configuration improves system testability and reliability. Every Application Specific Integrated Circuit (ASIC) component can be characterized on Vref margining in an on-chip configuration. Contrarily, Vref margining capability for all the ASICs is limited in an external voltage generator configuration by the inability of the hardware to reach and scope these components.

FIG. 4 is a circuit diagram illustrating a process-independent embodiment of the present invention. A five bit marginable control circuit is illustrated for exemplary purposes only. It is apparent to one skilled in the art that a marginable voltage control circuit may be comprised of any number of control bits.

In FIG. 4, current iddtn is provided as an input to a reference voltage generator and provides as output a voltage 400. The reference voltage generator may be of any well known designs of the prior art, including a voltage divider or a band gap reference voltage generator.

Comparator is coupled to node 400 at the negative input. The voltage at node 400 is reference voltage, Vref. The positive input is coupled to the voltage margining control block at node 415. The gate of P-type transistor P1 receives the output of comparator. The operation of comparator is controlled by clock signal, Tclk. A clock-based control is necessary because the signals a the positive and negative inputs may be slightly offset in time.

The source of transistor P1 is coupled to voltage source Vdd. The drain of transistor P1 is coupled to voltage margining control block at node 405.

Voltage margining control block is comprised of n resistors coupled in series. The first resistor in this array is coupled to transistor P1 at node 405. The nth resistor is coupled to common ground. Voltage margining control block is further comprised of an array of 5 P-type transistors, coupled in parallel. In construction of this circuit, n is defined to be at least as large as the number of P-type transistors in array. The resistor array is interleaved with the P-type transistor array at the source of the P-type transistors.

The voltage differential (delta V) at each level is maintained by the n resistors of equivalent resistance. Since the illustrated circuit is comprised of a five bit voltage margining control system, only the first five resistors are interleaved with the array of P-type transistors. The five control bits decide which Vref level is selected. Vref is selected at one of nodes 405, 410, 415, 420, or 425 and provided as the positive input to the comparator.

Thus, for the five level Vref generator illustrated in FIG. 4:

Delta V=Vref/n.

Assuming n=12 and Vref=0.6 v, the five levels are:

Vref+2 *(Delta V)=0.7 v
Vref+(Delta V)=0.65 v
Vref=0.6 v
Vref−(Delta V)=0.55 v
Vref−2 *(Delta V)=0.5 v N leads couple to the reference voltage generator to the on-chip ASICs at node 435.

Figure 5:
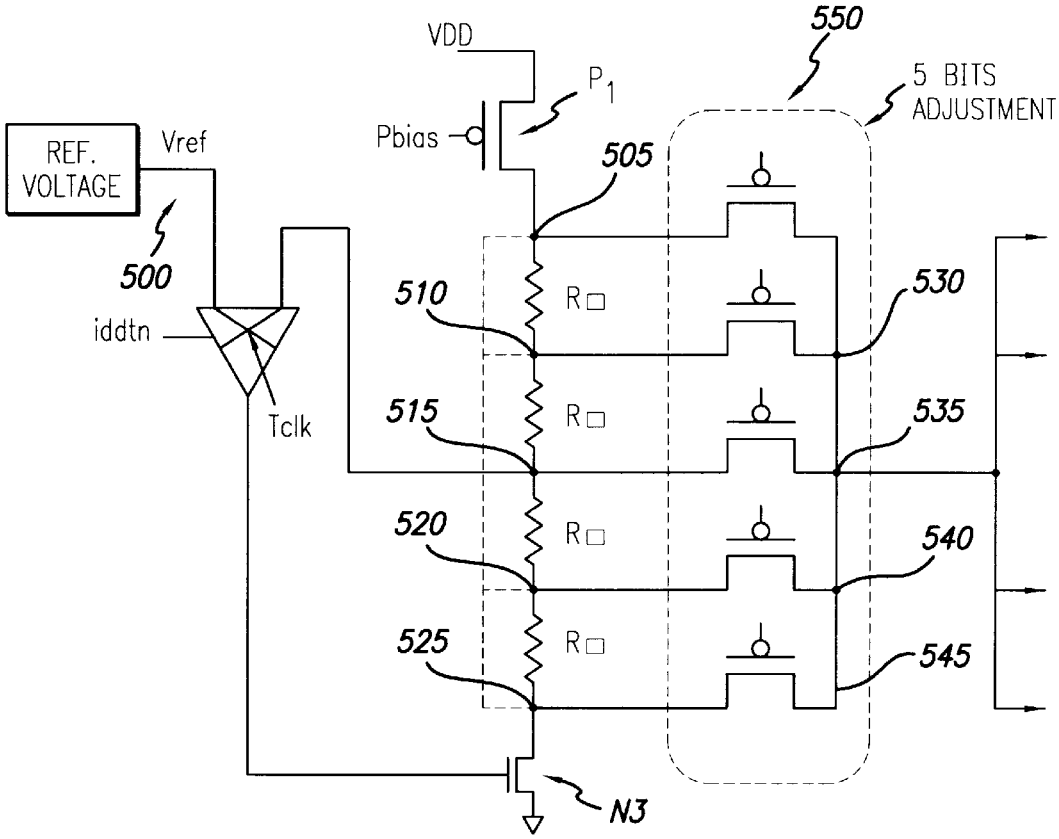
FIG. 5 is a circuit diagram illustrating a ground-bounce-noise free embodiment of the present invention.

FIG. 5 is a circuit diagram illustrating a ground-bounce-noise free embodiment of the present invention. A five bit marginable control circuit is illustrated for exemplary purposes only. It is apparent to one skilled in the art that a marginable voltage control circuit may be comprised of any number of control bits.

In FIG. 5, current iddtn is provided to a reference voltage generator to provide output 500. Comparator is coupled to node 500 at the negative input. The voltage at node 500 is reference voltage, Vref. The positive input is coupled to the voltage margining control block at node 515. The gate of N-type transistor N3 receives the output of comparator. The operation of comparator is controlled by clock signal, Tclk. A clock-based control is necessary because the signals a the positive and negative inputs may be slightly offset in time.

The source of P-type transistor P1 is coupled to voltage source Vdd. The drain of transistor P1 is coupled to voltage margining control block at node 505. Transistor P1 receives bias signal, Pbias, at the gate. Pbias may be any regular, stable voltage.

The drain of transistor N3 is coupled to voltage margining control block. The source of transistor N3 is coupled to common ground.

Voltage margining control block 550 is comprised of n resistors coupled in series. The first resistor in this array is coupled to transistor P1 at node 505. The nth resistor is coupled to common ground. Voltage margining control block is further comprised of an array of 5 P-type transistors, coupled in parallel. In construction of this circuit, n is defined to be at least as large as the number of P-type transistors in array. The resistor array is interleaved with the P-type transistor array at the source of the P-type transistors.

The voltage differential (delta V) at each level is maintained by the n resistors of equivalent resistance. Since the illustrated circuit is comprised of a five bit voltage margining control system, only the first five resistors are interleaved with the array of P-type transistors. The five control bits decide which Vref level is selected. Vref is selected at one of nodes 505, 510, 515, 520, or 525 and provided as the positive input to the comparator.

Thus, for the five level Vref generator illustrated in FIG. 5:

Delta V=Vref/n.

Assuming n=12 and Vref=0.6 v, the five levels are:

Vref+2 *(Delta V)=0.7 v
Vref+(Delta V)=0.65 v
Vref=0.6 v
Vref−(Delta V)=0.55 v
Vref−2 *(Delta V)=0.5 v N leads couple to the reference voltage generator to the on-chip ASICs at node 535.

Thus, a novel, on-chip DC voltage generator providing marginable voltage has been described.

We claim:

1. An on-chip DC voltage generator circuit having feedback control, said DC on-chip DC voltage generator circuit comprising:

a reference voltage generator for generating a reference voltage signal;

a receiver coupled with said reference voltage generator, said receiver receiving said reference voltage signal from said reference voltage generator and using said reference voltage signal to generate a data pattern having a voltage level associated with said reference voltage signal;

a centering circuit coupled with said receiver, said centering circuit improving a noise margin of said data pattern by generating a centering signal for centering said voltage level in said data pattern;

a coupling circuit coupled with said receiver and said reference voltage generator, said coupling circuit using said centering signal to generate a control information for regulating how said reference voltage signal is generated by said reference voltage generator; and a control circuit coupled with said coupling circuit, said control circuit comprising one of an automatic control and a manual software control;

wherein said coupling circuit also uses a signal of said control circuit to generate said control information for regulating how said reference voltage signal is generated by said reference voltage generator.

2. The circuit of claim 1, wherein said reference voltage generator is a processor independent voltage generator.

3. The circuit of claim 1, wherein said reference voltage generator is a ground-bounce-noise free generator.

4. The circuit of claim 1, wherein said reference voltage generator comprises a comparator;

a common ground of said reference voltage generator; and an N-type transistor coupled to said ground and said comparator .

5. The circuit of claim 1, wherein said reference voltage generator comprises:

a comparator having a negative input of said comparator, a positive input of said comparator, and an output of said comparator;

a voltage generator coupled with said comparator at said negative input of said comparator, said voltage generator generating an initial voltage signal;

a voltage margining circuit coupled with said comparator at said positive input of said comparator; and a first transistor coupled with said comparator at said output of said comparator.

6. The circuit of claim 5, wherein said voltage margining circuit provides one of a plurality of fixed voltage levels to said positive input of said comparator.

7. The circuit of claim 6, wherein said reference voltage signal received by said receiver is equal to said one of said of plurality of fixed voltage levels.

8. The circuit of claim 5, wherein said first transistor is a P-type transistor.

9. The circuit of claim 5, wherein said first transistor is an N-type transistor.

10. The circuit of claim 9, wherein said reference voltage generator comprises a common ground of said reference voltage generator, wherein said N-type transistor comprises a source of said transistor, and wherein said source of said transistor is directly connected to said common ground of said reference voltage generator.

11. The circuit of claim 5, wherein said comparator is controlled by a clock signal for offsetting any differences in time on said negative and positive inputs of said comparator.

12. The circuit of claim 5, wherein said voltage margining circuit comprises:

a plurality of resistors coupled in series; and a plurality of corresponding transistors coupled in parallel, said plurality of corresponding transistors comprising a plurality of drains interspersed with said plurality of resistors;

wherein said plurality of resistors is coupled with said comparator at said positive input of said comparator.

13. The circuit of claim 12, wherein said plurality of resistors is further coupled with said comparator at said output of said comparator through said first transistor.

14. The circuit of claim 13, wherein a voltage level at said positive input of said comparator is equal to said reference voltage signal received by said receiver.

15. A method for providing a feedback control to an on-chip DC voltage generator, said method comprising:

generating a reference voltage signal;

receiving said reference voltage signal;

using said reference voltage signal to generate a data pattern having a voltage level associated with said reference voltage signal;

generating a centering signal for centering said voltage level in said data pattern;

generating a control signal from a control circuit comprising one of an automatic control and a manual software control; and using said centering signal and said control signal to regulate how said reference voltage signal is generated.

16. The method of claim 15, wherein said generating said reference signal comprises:

providing a voltage to a negative input of a comparator;

providing a fixed voltage level to a positive input of said comparator;

comparing said negative input of said comparator with said positive input of said comparator;

producing an output of said comparator based on said compared negative and positive inputs of said comparator;

receiving said output of said comparator by a transistor.

17. The circuit of claim 16, wherein said transistor comprises an N-type transistor.

18. An on-chip DC reference voltage generator circuit comprising:

a comparator having a negative input of said comparator, a positive input of said comparator, and an output of said comparator;

a voltage generator coupled with said comparator at said negative input of said comparator, said voltage generator generating an initial voltage signal;

a voltage margining circuit coupled with said comparator at said positive input of said comparator; and a first transistor coupled with said comparator at said output of said comparator;

wherein said voltage margining circuit provides a fixed voltage level to said positive input of said comparator.

19. The circuit of claim 18, further comprising a common ground of said circuit, wherein said first transistor is an N-type transistor comprising a source of said transistor and wherein said source of said transistor is directly connected to said common ground of said circuit.

20. The circuit of claim 18, wherein said voltage margining circuit comprises:

a plurality of resistors coupled in series; and a plurality of corresponding transistors coupled in parallel;

wherein each of said corresponding transistors is used to provide a different fixed voltage level for said voltage margining circuit.

* * * * *